US006526593B2

(12) United States Patent
Sajovic

(10) Patent No.: US 6,526,593 B2
(45) Date of Patent: Mar. 4, 2003

(54) GLOVE WITH IMPROVED GRIP

(76) Inventor: Robert J. Sajovic, 8760 Applewood Ct., Mentor, OH (US) 44060

( * ) Notice: Subject to any disclaimer, the term of this patent is extended or adjusted under 35 U.S.C. 154(b) by 0 days.

(21) Appl. No.: 09/772,764

(22) Filed: Jan. 30, 2001

(65) Prior Publication Data

US 2001/0044950 A1 Nov. 29, 2001

Related U.S. Application Data

(63) Continuation-in-part of application No. 09/580,200, filed on May 26, 2000, now abandoned.

(51) Int. Cl.[7] ..... A41D 19/00
(52) U.S. Cl. ..... 2/161.8; 2/161.1; 2/161.6
(58) Field of Search ..... 2/161.6, 160, 159, 2/161.1, 161.3, 161.8

(56) References Cited

U.S. PATENT DOCUMENTS 730,051 A * 6/1903 Scott
1,072,560 A * 9/1913 Baskin
1,346,683 A * 7/1920 Reynolds
1,885,572 A 11/1932 Wood et al. ..... 2/159
3,883,899 A * 5/1975 Ganz
4,979,609 A * 12/1990 Harlan et al.
5,608,912 A * 3/1997 Cumberland
5,636,381 A * 6/1997 Brogden
5,782,516 A 7/1998 Partida ..... 294/25
5,822,824 A * 10/1998 Dion
6,055,669 A 5/2000 Albert ..... 2/161.1
6,081,928 A * 7/2000 Bourne
6,115,931 A * 9/2000 Arcand

FOREIGN PATENT DOCUMENTS

DE 29617984 * 3/1997
EP 0 503 982 A2 9/1992
FR 2788680 * 7/2000
GB 1473744 * 5/1977

* cited by examiner

*Primary Examiner*—Rodney M. Lindsey
(74) *Attorney, Agent, or Firm*—Renner, Kenner, Greive, Bobak, Taylor & Weber

(57) ABSTRACT

A glove comprising a palm; a thumb; at least one finger; and a plurality of suction devices attached to the palm, at least one finger, or both the palm and at least one finger, where said suction devices have a Shore A durometer of from about 20 to about 90.

6 Claims, 7 Drawing Sheets

GLOVE WITH IMPROVED GRIP

This application is a continuation-in-part application of U.S. patent application Ser. No. 09/580,200, filed on May 26, 2000 now abandoned.

TECHNICAL FIELD

This invention relates to gloves that include at least one suction device. These gloves advantageously improve the ability of the user to grip a ball such as football.

BACKGROUND OF THE INVENTION

Gloves are often worn by athletes participating in sporting events. These gloves are typically worn for warmth, to improve overall stability of the hand, or to improve handling of a ball such as in the case of a football player. Traditionally, these gloves have been made of leather or a similar material, and in recent years gloves made of synthetic materials such as rubber have been employed.

While the gloves of the prior art have provided some advantages, especially with respect to warmth, the gloves of the prior art have not been able to provide desired handling or gripping a football. This is particularly true in cold or wet environments, or where the wearer of the glove is in a hostile environment.

SUMMARY OF INVENTION

In general the present invention provides a glove comprising a palm; a thumb; at least one finger; and a plurality of suction devices attached to the palm, at least one finger, or both the palm and at least one finger, where said suction devices have a Shore A durometer of from about 20 to about 90.

The present invention also includes a glove comprising a palm having an outer surface; a thumb having an outer surface; at least one finger including a front outer surface; and a plurality of suction devices attached to the outer surface of said palm, the front outer surface of said at least one finger, or both the outer surface of said palm and the front outer surface of said at least one finger, where said suction devices are characterized by having a top surface having a diameter that is greater than ½ inch.

Still further, the present invention provides a glove comprising a palm; a thumb; at least one finger; and a plurality of suction devices attached to said palm, said at least one finger, or both said palm and said at least one finger, where said plurality includes a first set of suction devices having a diameter that is greater than ½ inch and a second set of devices having a diameter that is less than ½ inch.

The gloves of the present invention overcome the problems associated with the prior art by enhancing the glove wearer's grip on a ball. In one embodiment, this is accomplished by employing suction devices that have a specific degree of hardness and therefore a certain amount of tackiness. In another embodiment, these advantages are accomplished by using suction devices that have a certain surface area or diameter, which improves the grip of the glove. In yet another embodiment, the advantages of this invention are accomplished by employing a glove having gripping devices that have various sizes, durometer, or both size and durometer. The softness, size, combination, and arrangement of the suction devices each independently provide sustained grip on a ball that requires force to overcome.

PREFERRED EMBODIMENT FOR CARRYING OUT THE INVENTION

The glove includes a palm portion, a thumb, at least one finger, and a plurality of suction devices affixed to at least one of the palm portion, the thumb, and the finger. The suction devices, which may also be referred to as suction cups, serve to improve the ability of the glove wearer to catch, grab, or hold onto objects such as a football. The glove may optionally include a back portion, a wrist portion, a tightening device, and webbing.

Figure 1:
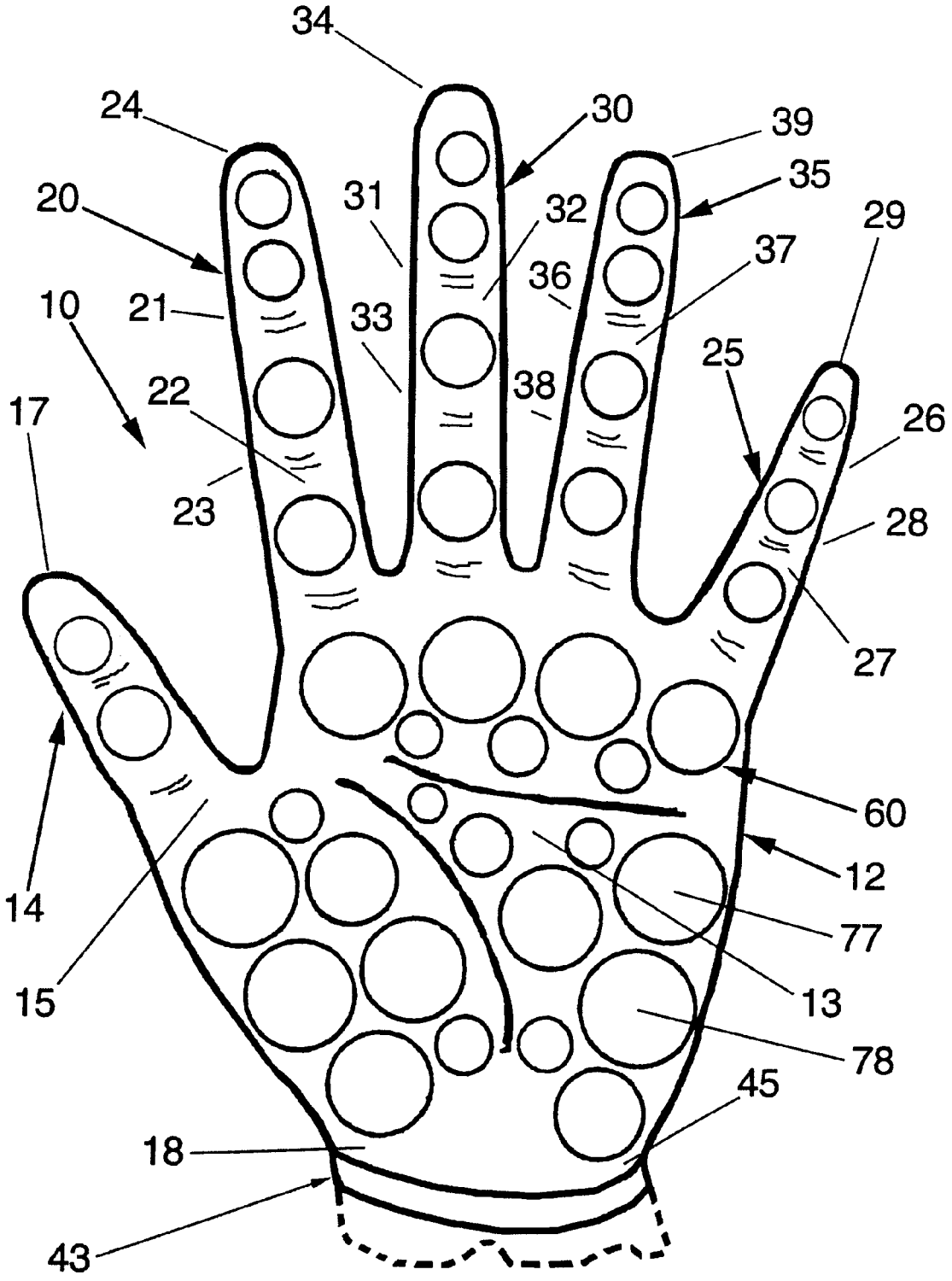
FIG. 1 is a perspective view of the front surface of a glove according to the present invention.

With reference to FIG. 1, the palm portion 12 of glove 10 is shown. As with other components of the glove, the palm portion has an interior surface, which is not shown and which contacts the palm of the person wearing the glove, and an exterior surface 13.

Figure 2:
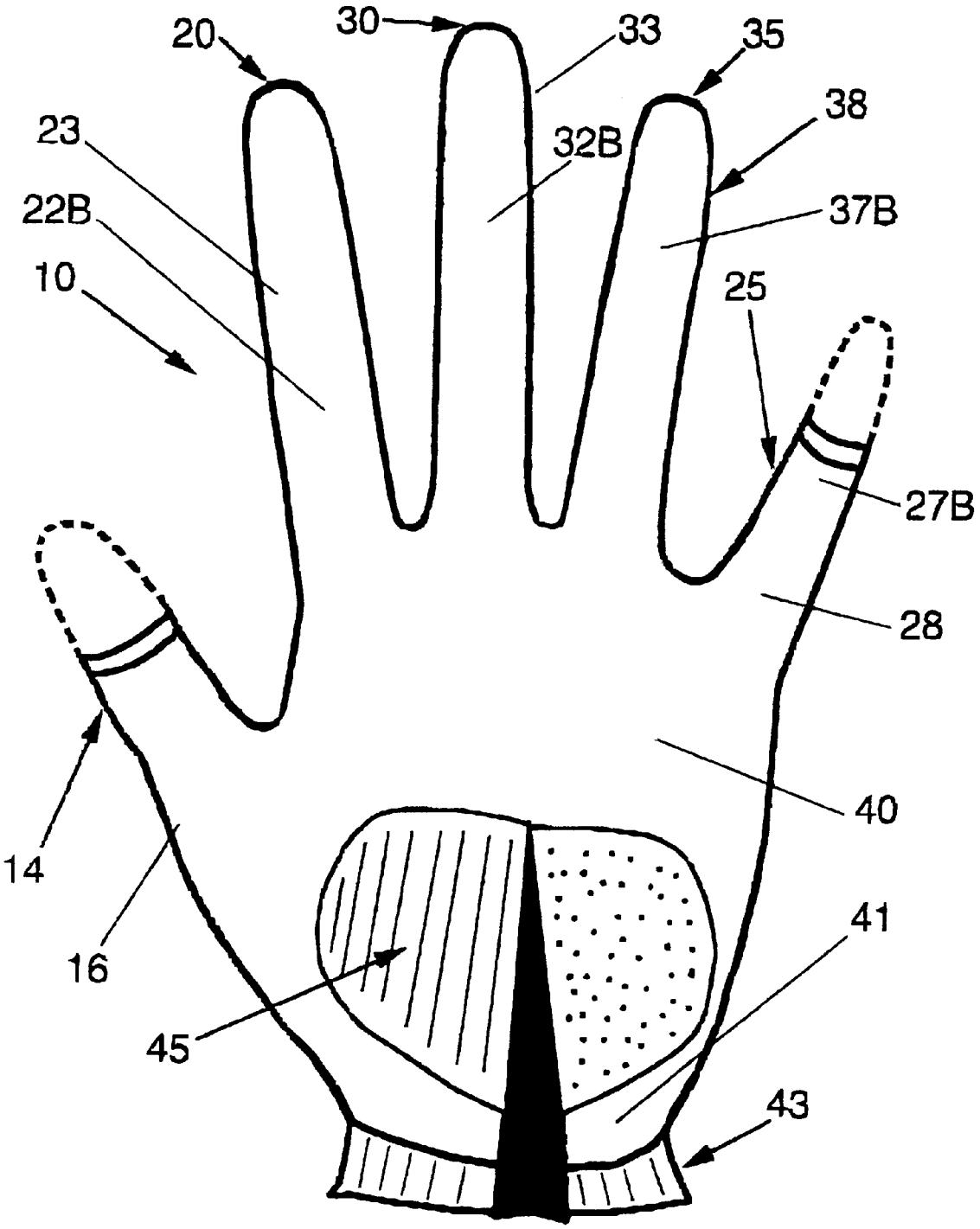
FIG. 2 is a perspective view of the back surface of a glove according to the present invention having a securing device.

As shown throughout the Figures, thumb 14 attaches to palm 12. The thumb 14, like the palm portion 12, includes an interior surface, which is not shown, and an exterior surface. This exterior surface includes a front surface 15, which is the surface that can contact an object when the wearer's hand closes to grab or grip an object. The back surface 16 of thumb 14 is shown in FIG. 2. Thumb 14 may completely encase the wearer's thumb, in which case thumb 14 is generally cylindrical and closed at tip 17 as shown in FIG. 1. Alternatively, as shown in FIG. 2, thumb 14 may not completely encase the wearer's thumb, and therefore thumb 14 is truncated. Thumb 14 also includes knuckle section 18., as shown in FIG. 1.

Figure 3:
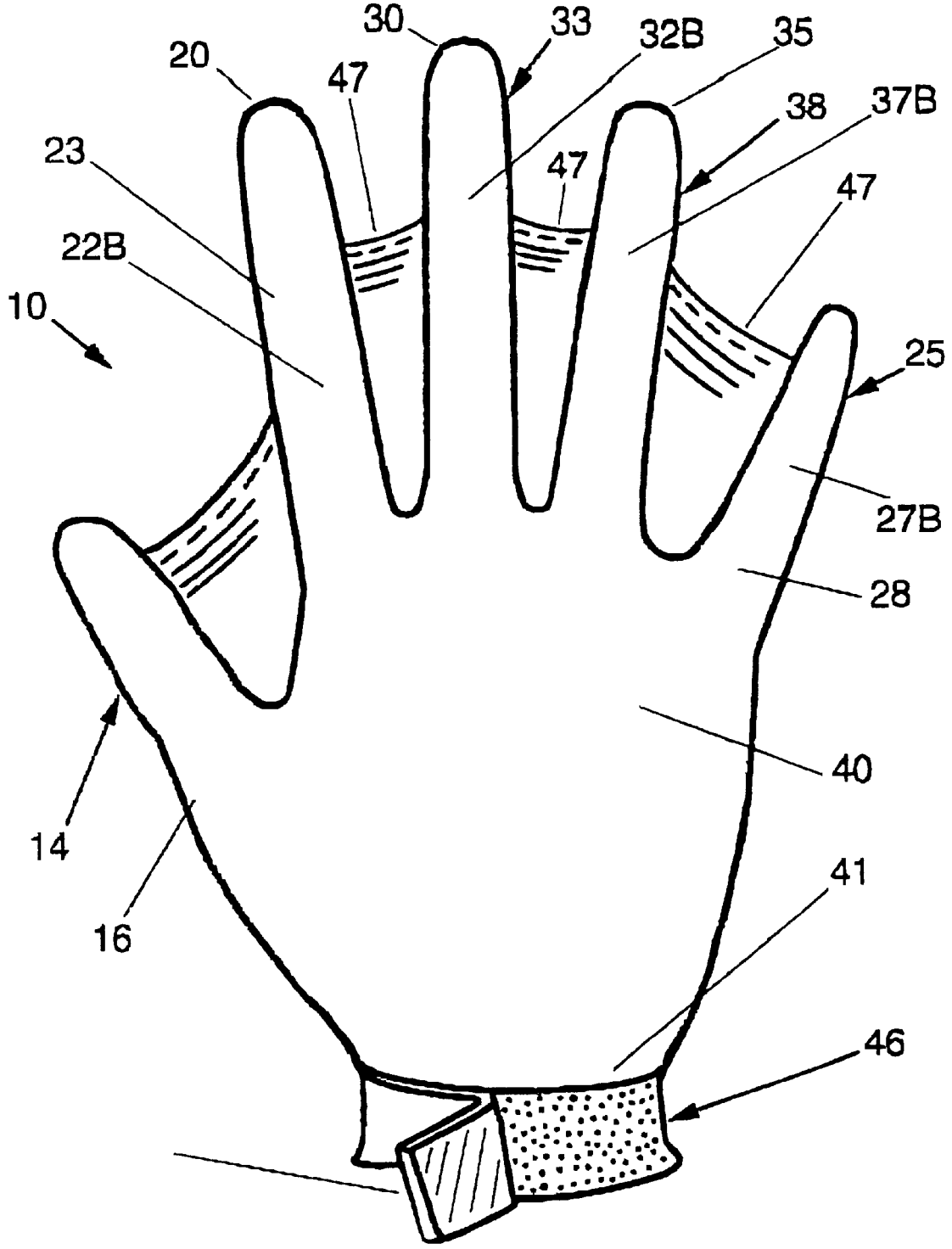
FIG. 3 is a perspective view of the back surface of a glove according to the present invention and having a alternate securing device, as well as webbing.

Glove 10 will also include at least one finger. These fingers may include index finger 20, little finger 25, middle finger 30, or ring finger 35. As with thumb 14, fingers 20, 25, 30, and 35 include an interior and exterior surface. They likewise include front surfaces 22, 27, 32, and 37, respectively, as shown in FIG. 1. As shown in FIGS. 2 and 3, they also include back surfaces 22B, 27B, 32B, and 37B, respectively. Each of fingers 20, 25, 30 and 35 may completely encase the wearer's respective fingers as shown in FIG. 1. Preferably, each of fingers 20, 25, 30, and 35 will generally be cylindrical and closed at tips 24, 29, 34, and 39 of each of the respective fingers. Also, each of fingers 20, 25, 30, and 35 include a first knuckle portion 21, 26, 31, and 36 for each respective finger, and a second knuckle portion 23, 28, 33 and 38 for each respective finger.

Alternatively, the fingers may be truncated. As shown by way of example in FIG. 2, little finger 25 may be truncated. Although shown for purposes of example with respect to little finger 25, index finger 20, middle finger 30, or ring finger 35 may likewise be truncated. Each of fingers 20, 25, 30, and 35 attach to palm portion 12.

Figure 4:
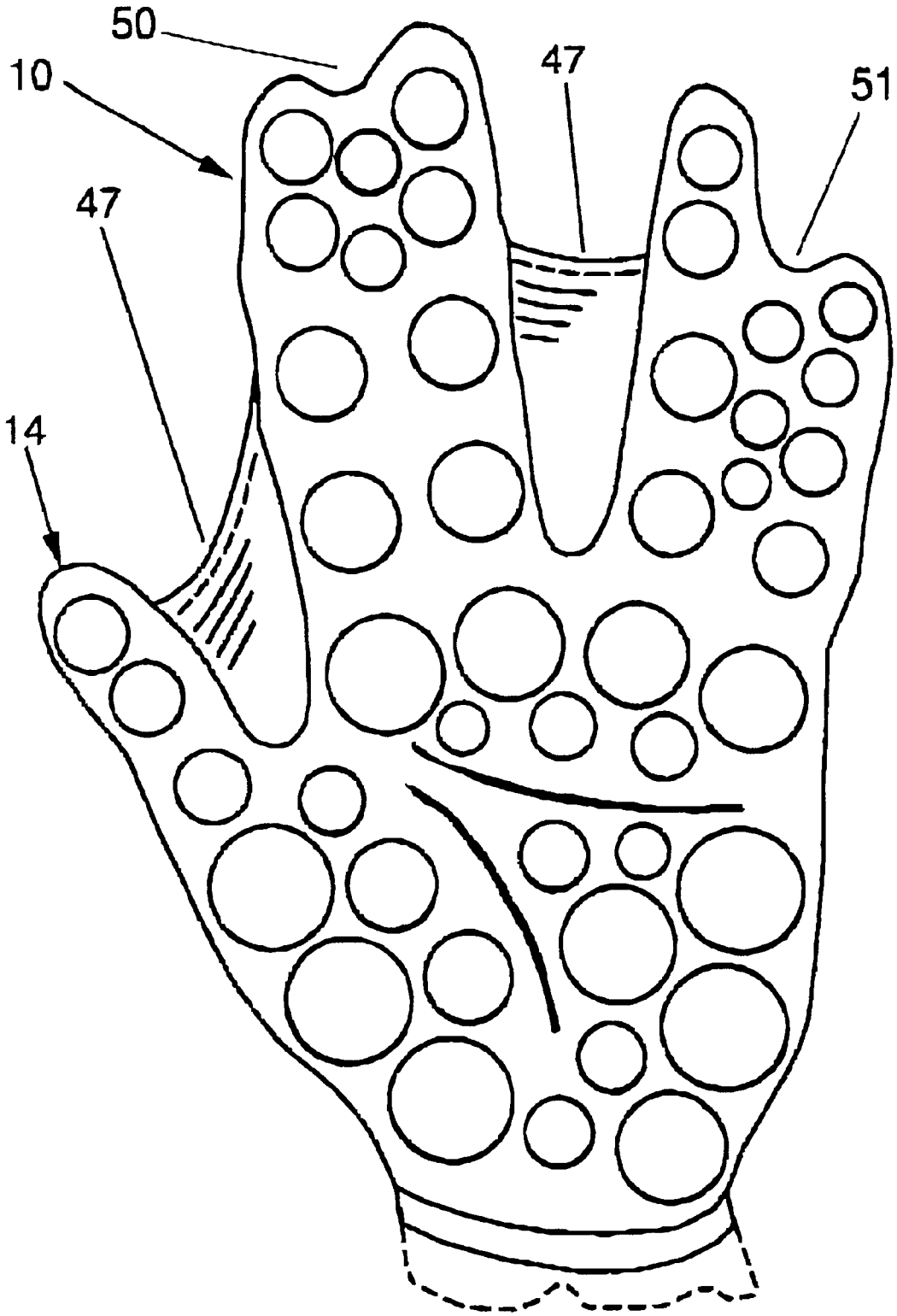
FIG. 4 is a perspective view of a the front of a glove of one embodiment of the present invention wherein the glove includes two fingers, as well as webbing.
Figure 5:
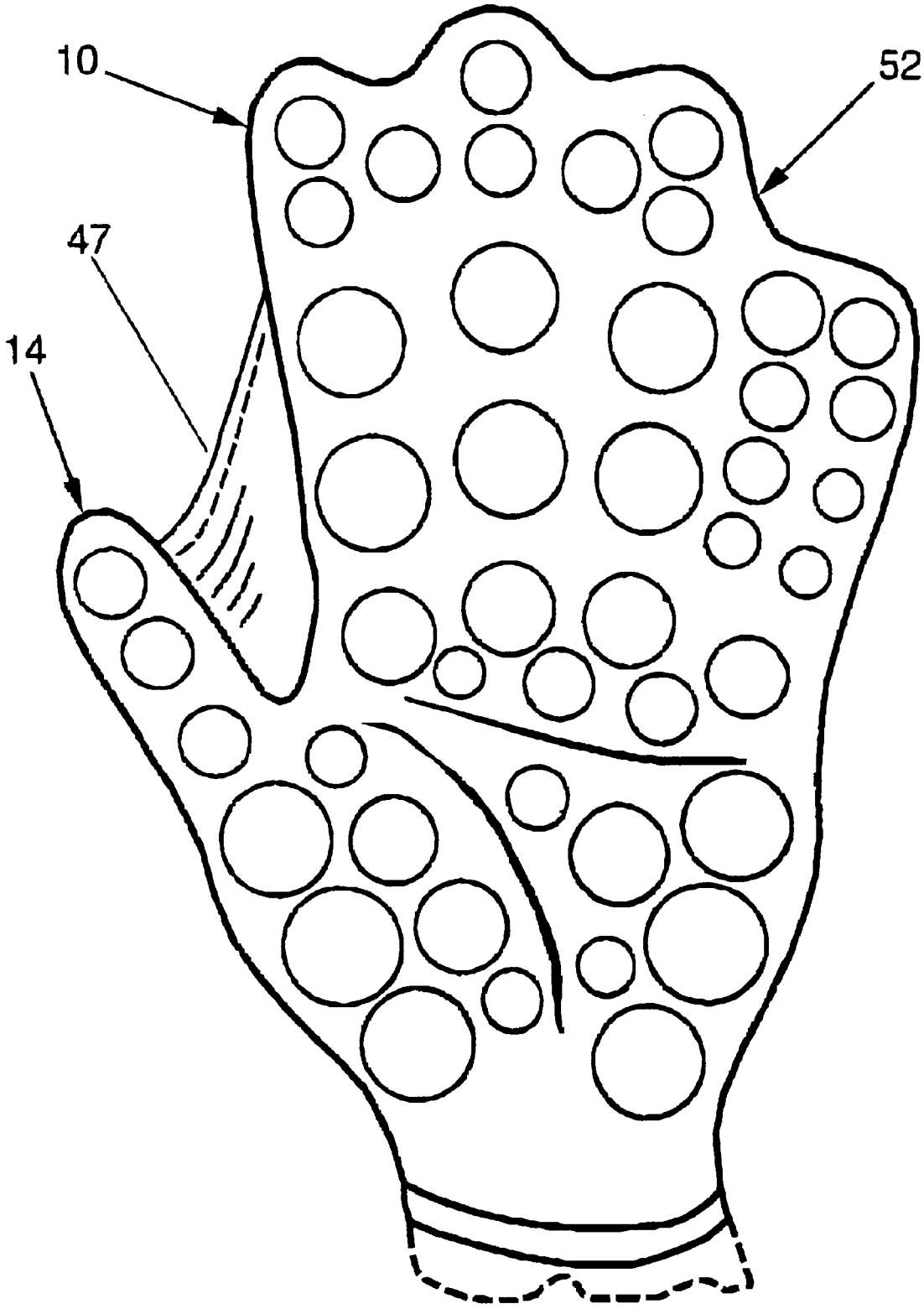
FIG. 5 is a perspective view of the front of one glove according to the present invention wherein the glove is a mitten, as well as webbing.

Preferably, glove 10 will include each of index finger 20, little finger 25, middle finger 30, and ring finger 35. As shown in FIGS. 4 and 5, glove 10 may include fingers that can encase more than one of the wearer's fingers. For example, and as specifically shown in FIG. 4, finger 50 can encase the wearer's index and middle finger, and finger 51 can encase the wearer's little finger and ring finger. Alternatively, and as specifically shown in FIG. 5, finger 52 of glove 10 encases the wearer's index finger, truncated middle finger, and ring finger. This type of glove configuration may also be referred to as a mitten. Despite the fact that fingers 50, 51, 52 encase more than one of the wearer's fingers, these components of glove 10 will nonetheless be referred to as a finger. Moreover, any discussion herein that is generally directed toward a finger will apply to fingers 50, 51, and 52 as in FIGS. 4 and 5, as well as 20, 25, 30, and 35 as shown in FIG. 1.

Glove 10 may include a back portion 40 as shown in FIGS. 2 and 3. This component of glove 10 is optional inasmuch as an operable glove can be made and used without back portion 40. It is, however, preferred that glove 10 include back portion 40. As with the other components of the glove, back portion 40 will include an interior and exterior surface. Back portion 40 extends across the back of the glove and attaches on either side of the palm portion 12, as well as to each of back 22B, 27B, 32B, and 37B as shown in FIG. 2 and 3.

Glove 10 may include wrist portion 43. This component of glove 10 is optional inasmuch as operable gloves can be constructed and used without a wrist portion. Preferably, wrist portion 43 will extend around the lower parameter of glove 10. Accordingly, wrist portion 43 will attach to the lower portion 11 of palm 12, the lower portion or ball 19 of thumb 14 as shown in FIG. 1, and, as shown in FIG. 3, the lower portion 41 of back 40. Wrist portion 40 may be comprised of the same material that comprises the other components of the glove, or may include an elastic band, a band that may be secured by hook and loop, i.e., Velcro™ fastener, or the like.

As shown in FIGS. 2 and 3, glove 10 may include an optional tightening device. For example, as shown in FIG. 2, glove 10 may include device 45, which is positioned within the back 40 of glove 10. This device functions by allowing the user to pull separate portions of back 40 together and thereby tighten palm portion 20 and back 40 around the wearer's hand. Once tightened, device 45 can be secured by numerous attaching devices including hook and loop, i.e., Velcro™ fasteners. These devices are well known in the manufacture of gloves. Alternatively, as shown in FIG. 3, a tightening device 46 can be located in the wrist portion.

As shown in FIGS. 3–5, glove 10 may also optionally include webbing between fingers. For example, as shown in FIG. 3, webbing 47 is placed between fingers 20 and 30, 30 and 35, and 35 and 25, as well as thumb 14 and finger 20. As shown in FIG. 4., webbing 47 is placed between fingers 50 and 51, as well as between thumb 14 and finger 52 as shown in FIGS. 4 and 5. This webbing serves to stabilize glove 10, or at least a portion thereof, and adds strength and unity to the fingers. Therefore, the webbing can be placed between each of the fingers and between the thumb and a finger, or only between selected fingers.

The webbing can be made of various flexible natural or synthetic materials including, but not limited to, leather, rubber, and various synthetic textiles that may comprise nylon, polyester, and polyurethane yarns. The webbing can be attached to the thumb or fingers by various methods including, but not limited to, the use of an adhesive, melt bonding, or stitching.

The art of making gloves is well known. Therefore, despite the fact that glove 10 has been described with various components, the materials used in making the glove may not necessarily be segregated into the various components. For example, in the case where the glove is made of a type of synthetic materials such as rubber or nylon, the various components of the glove are compositionally the same and there is no exact point of transition between the various components of the glove. Nonetheless, glove 10 has been described with reference to the foregoing components so as to facilitate not only a description of separate components in the case where such components may exist, but also to facilitate specific locations of glove 10.

Glove 10 may be made from a variety of materials or a combination thereof. The materials and the processes for constructing these materials into a glove are well known in the art. These materials include, but are limited to, natural materials such as leather, which is typically stitched together to form a glove, woven materials that include natural, synthetic or blends of natural and synthetic yarns, dipped gloves natural rubber or neoprene gloves, or thermoextruded or thermoset rubbery gloves including those made from thermoplastic elastomers. Examples of synthetic yarns include nylon, polyester, and spandex (polyurethane) yarns. Preferred materials include materials that are somewhat porous but that do not absorb a great deal of moisture. Because the gloves of this invention are advantageously worn by athletes participating in a sporting event, it is preferred that the material allow perspiration from the hand to escape from the glove. These materials are well known in the art inasmuch as gloves for use by athletes, especially football players, are well known in the art.

The interior surface of the glove may be different than the exterior surface. For example, the interior surface may include a cotton lining, which may be beneficial in cold weather conditions.

As shown in most of the figures, glove 10 includes a plurality of suction devices 60 that are attached to at least one of the exterior surface 13 of palm portion 12, thumb front surface 15, or front surface of at least one of the fingers such as the front of index finger 22, front of little finger 27, front of middle finger 32, or front of ring finger 37. In a preferred embodiment, glove 10 includes a plurality of suction devices 60 on each of front surface 15 of thumb 14, exterior surface 13 of palm portion 12, and the front surface of each of the fingers.

Figure 6:
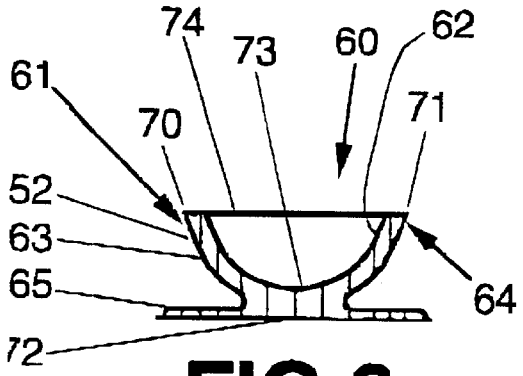
FIG. 6 is a side cross-sectional view of a suction device according to the present invention.
Figure 7:
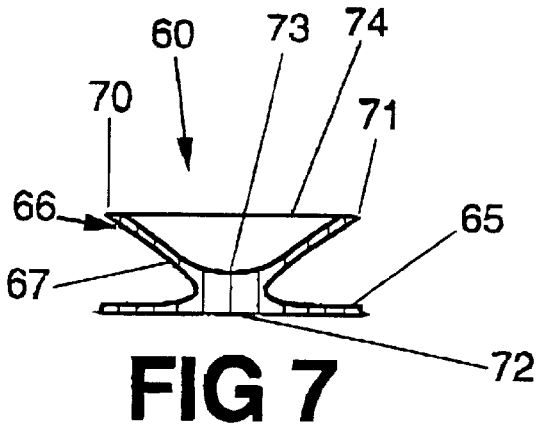
FIG. 7 is a side cross-sectional view of an alternative suction device according to the present invention.

The configuration of suction devices 60 is best shown in FIGS. 6 and 7. As shown in FIG. 6, suction device 60 includes a cup 61 having concave surface 62 and convex surfaces 63 and 64 on either side of a preferred base 65. Alternatively as shown in FIG. 7, suction device 60 is a cone 66 having side walls 67. Preferably, the cup and optional base of suction device 60 are made of the same material.

With reference to FIG. 1, a top perspective view of suction device 60 is shown. In a preferred embodiment, the suction device is round with the diameter being defined as the distance from end 70 to end 71 as shown in FIGS. 6 and 7. Alternatively, suction device 60 is oval or elliptical. In the case of a top surface that is shaped other than a circle, the diameter measurements provided herein are with respect to the largest diameter for the configuration of the top surface.

Figure 9:
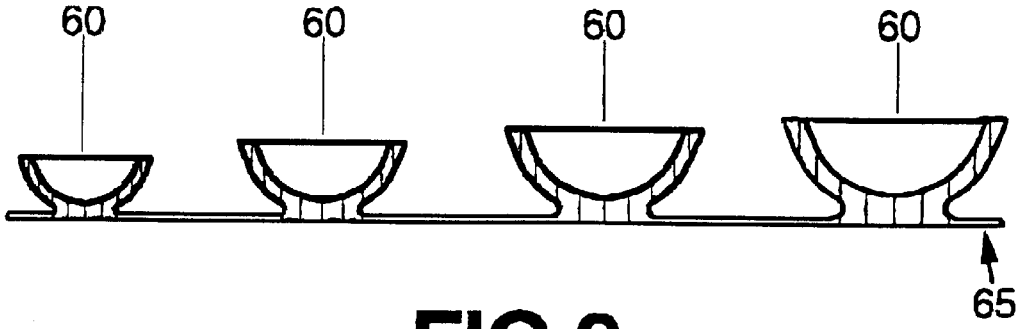
FIG. 9 is a side cross-sectional view of a plurality of suction devices according to the present invention where the suction devices share a base.

Each suction device 60 may have its own base 65, as shown in FIGS. 6 and 7, or multiple suction devices 60 may share a base as shown in FIG. 9.

The size of the suction devices can be defined in terms of the diameter of the cup or cone, the height of the base, which is the distance between the bottom of the base 72 and the bottom surface 73 of cup 61 or cone 66, and the depth of the cup, which is the distance between the bottom surface 73 and line 74 formed between end 70 and end 71 as shown in FIGS. 6 and 7.

In general, the diameter of suction devices 60 should be from about ¼" to about 6", preferably from about ⅜" to about 3", more preferably from about ½"to about 2 ½", and even more preferably from about ⅝" to about 1 ½". As will be described in greater detail hereinbelow, glove 10 may include a mixture of suction devices 60 with varying diameters.

In general, the depth of cup 61 or cone 66 should be from about ⅛" to about 1, preferably from about ¼" to about ¾", and more preferably from about ⅜" to about ⅝". Glove 10 may include a mixture of suction devices 60 with varying cup depths.

In general, the height of the base should be from about 1/32" to about ½", preferably from about 1/16" to about ⅜", and more preferably from about ⅛" to about ¼". Glove 10 may include a mixture of suction devices 60 with varying heights.

As shown in FIG. 1, glove 10 includes a plurality of suction devices 60. The term plurality refers to more than one suction device. The upper limit on the number of suction devices 60 that can be attached to exterior surface 13 of palm 12, front surfaces of the thumb 15, or the fingers, is limited by the size of the glove and the size of the suction devices.

In a preferred embodiment, glove 10 will include a plurality of suction devices 60, where the plurality includes a first set of suction devices having a diameter that is greater than ½", and a second set of suction devices where the suction devices have a diameter that is less than ½". More preferably, glove 10 will include a plurality of suction cups 60 where the plurality includes a first set of suction devices having a diameter that is greater than ¾", a second set of suction devices having a diameter that is less than ½", and a third set of suction devices that have a diameter from ½" to ¾".

Figure 10:
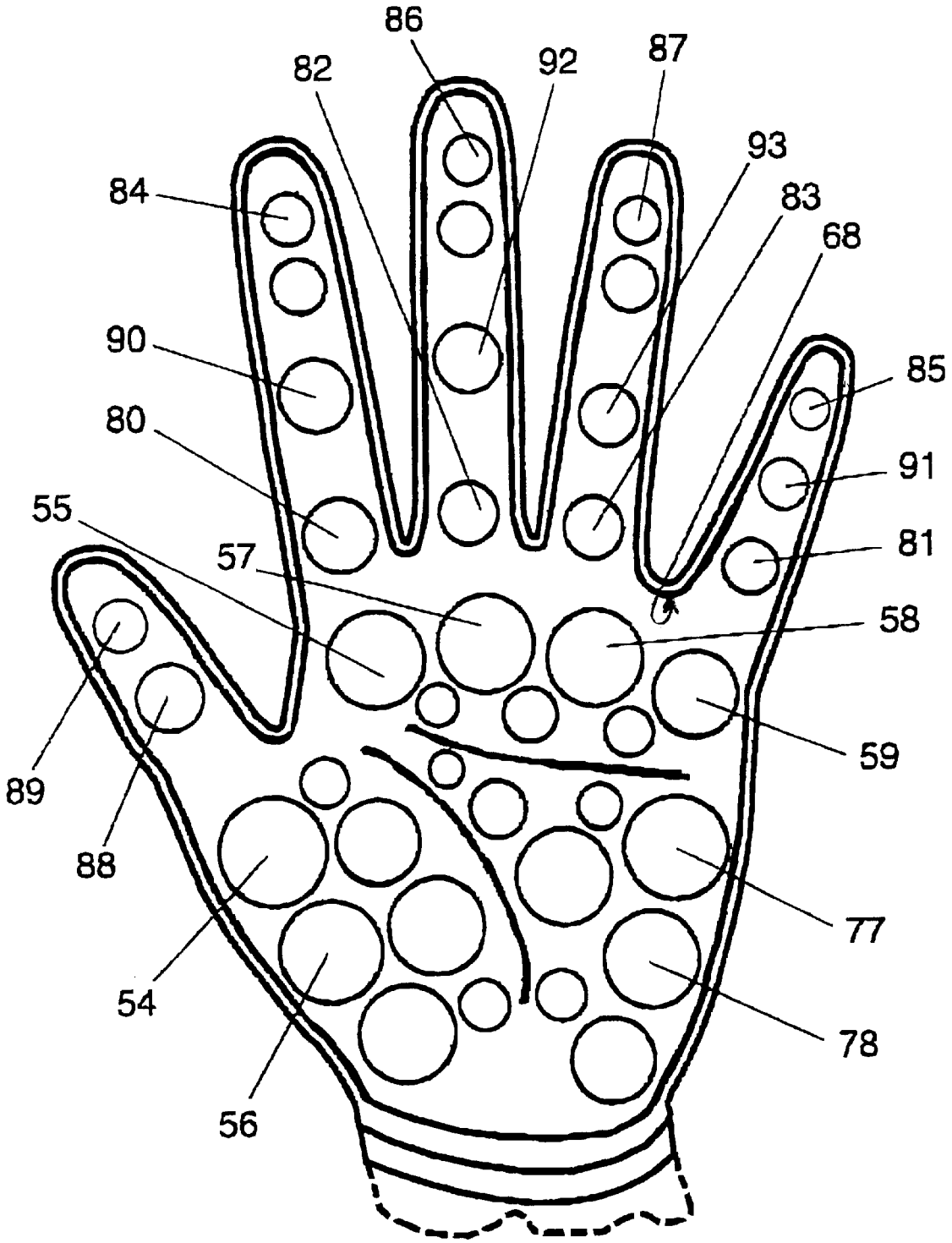
FIG. 10 is a perspective view of the front of glove where the suction devices share a common secondary base.

The arrangement of the suction devices 60 on exterior surface 13 of palm portion 12, front surface 15 of thumb 14, and the front surfaces of the various fingers can vary based on the application. In one embodiment, as shown in FIG. 10, the palm portion 12 will include a suction device 55 having a diameter from about ¼" to about 1¼" located adjacent to index finger 20, a second suction device 59 having a diameter from about ¼" to about 1¼" located adjacent to little finger 25, a third suction device 57 having a diameter from about ¼" to about 1¼" located adjacent to middle finger 30, a fourth suction device 58 having a diameter from about ¼" to about 1¼" located adjacent to ring finger 35, and fifth and sixth suction devices 54 and 56 having a diameter from about ¼" to about 1¼ located adjacent to thumb 14.

Even more preferably, exterior surface 13 of palm 12 will further include two suction devices 71 and 78, each having a diameter from about ¼" to about 1¾, located opposite to thumb 14. Still further, glove 10 includes suction devices 80, 81, 82, and 83 having a diameter from about ½ to about 2" located below the knuckle regions 21, 26, 31, and 36, respectively, of each of the fingers 20, 25, 30, and 35. Still further, the preferred embodiment may include suction devices 84, 85, 86, and 87 having a diameter from about ¼"to about ½" located in the tips 24, 29, 34, and 39 of fingers 20, 25, 30, and 35, respectively. Likewise, thumb 14 will include suction device 88 having a diameter from about ½" to about 1½" located in the knuckle region 18 of thumb 14 and suction device 89 having a diameter from about ¼" to about ¾" located at or near the tip 17 of thumb 14. Still further, this embodiment may include suction devices 90, 91, 92, and 93, which have a diameter from about ½" to 2", below second knuckle regions 23, 28, 33, and 38 of FIGS. 20, 25, 30, and 35, respectively.

The suction devices should generally be made of a soft polymeric material. Preferably, this material should have a durometer reading of from about 20 to about 90, more preferably from about 25 to about 85, and even more preferably from about 30 to about 75. These durometer readings are determined according to ASTM D2240 by using the Shore A scale. In a preferred embodiment, the suction devices should be made of an elastomeric material.

The materials that can be employed to make the suction devices include natural rubber, as well as synthetic polymers including, but not limited to, thermoset elastomers and thermoplastic elastomers. The synthetic polymers can be selected from polyisoprene, polybutadiene, neoprene, styrene/butadiene copolymer rubber ethylene/propylene/diene terpolymer rubber, polysilicone, styrene/butadiene/styrene terpolymer, and styrene/ethylene-butene/styrene terpolymer. These synthetic polymers are commercially available from a number of sources. For example, styrene/butadiene/styrene terpolymer and styrene/ethylene-butene/styrene terpolymer are available under the tradename KRATON™(Shell Chemicals; Houston, Tex.). The suction device may also be made from a blend of polymeric materials. These blends are available, for example, under the name Santoprene™(AES; Akron, Ohio).

Glove 10 is typically constructed by attaching suction devices 60 to a preconstructed glove. This attachment can be achieved by various methods, most of which depend on the nature of the material that is used for the suction devices and the glove itself. In one embodiment, the suction devices can be attached by using an adhesive. Without undue experimentation or calculation, those skilled in the art will be able to select an adhesive to attach the suction devices to the to the glove based on the composition of the suction devices and gloves. Adhesives that can be employed include urethane, epoxy, and rubbery adhesives. Other methods of attachment include heat welding, sonic welding and stitching.

Figure 8:
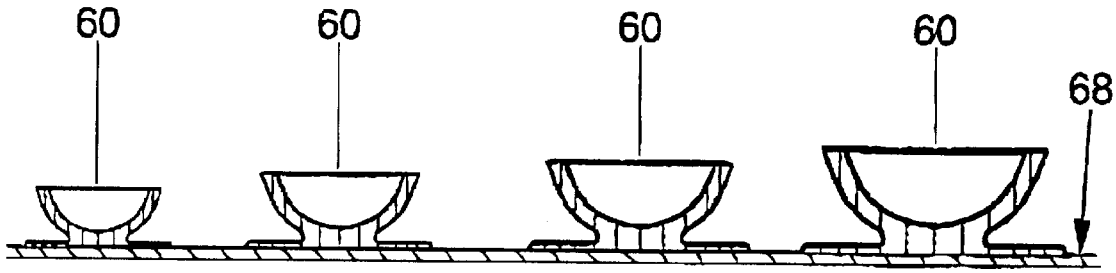
FIG. 8 is side cross-sectional view of a plurality of suction devices according to the present invention where the suction devices are attached to a secondary base.

In one embodiment, suction devices 60 are attached to glove 10 by using a secondary base 68 as shown in FIGS. 8 and 10. FIG. 8 shows four suction devices 60 attached to secondary base 68. FIG. 10 shows glove 10 having secondary base 68 attached thereto. Once attached to secondary base 68, suction devices 60 can then be attached to glove 10 by attaching secondary base 68 to glove 10. This method of attachment can include the use of an adhesive, as noted above, or by stitching the secondary base to the glove. Suction devices 60 can be attached to secondary base 68 by using methods similar to those used when suction devices 60 are attached directly to glove 10. Secondary base 68 can be made from materials similar to those used for making suction devices 6 or glove 10. Preferred materials include meshes that are made from synthetic yarns such as nylon, polyester, and polyurethane yarns. Also, meshes that are made from thermoplastic materials such as vinyl and/or alpha-olefin blends are also useful. Because suction devices 60 may be attached to glove 10 by either directly attaching the device to the glove or by using an optional secondary base, the use of the term attach or a variation thereof, as used herein, will refer to either method of attachment.

While the best mode and preferred embodiment of the invention have been set forth in accord with the Patent Statues, the scope of this invention is not limited thereto, but rather is defined by the attached claims. Thus, the scope of the invention includes all modifications and variations that may fall within the scope of the claims.

What is claimed is:

1. A glove comprising:

a palm;

a thumb;

at least one finger; and a plurality of suction devices attached to said palm, said at least one finger, or both said palm and said at least one finger, where said plurality includes a first set of suction devices having a diameter that is greater than ½ inch and a second set of devices having a diameter that is less than ½ inch.

2. The glove of claim 1, where said plurality of suction devices includes a first set of devices having a diameter less than ½", a second set of devices having a diameter greater than ¾", and a third set of devices having a diameter from ½" to ¾".

3. The glove of claim 1, where said plurality of suction devices are attached to said palm, said thumb, and said at least one finger.

4. The glove of claim 1, where the glove includes four fingers, and where said plurality of suction devices are attached to said four fingers.

5. The glove of claim 1, where said suction devices have a Shore A durometer of from about 20 to about 90.

6. The glove of claim 1, where said suction devices have a Shore A durometer of from about 25 to about 85.

* * * * *